US006216867B1

(12) United States Patent
Haseltine et al.

(10) Patent No.: US 6,216,867 B1
(45) Date of Patent: Apr. 17, 2001

(54) WHEELCHAIR CONTAINER

(75) Inventors: Florence P. Haseltine, New Haven; George DeBush, Hamden, both of CT (US)

(73) Assignee: Haseltine Systems, Rockville, MD (US)

( * ) Notice: Subject to any disclaimer, the term of this patent is extended or adjusted under 35 U.S.C. 154(b) by 0 days.

(21) Appl. No.: 09/523,612

(22) Filed: Mar. 13, 2000

Related U.S. Application Data

(62) Division of application No. 08/871,175, filed on Jun. 9, 1997, now Pat. No. 6,036,012.
(60) Provisional application No. 60/019,664, filed on Jun. 12, 1996.

(51) Int. Cl.[7] ..... B65D 85/68
(52) U.S. Cl. ..... 206/335; 220/4.28
(58) Field of Search ..... 206/335; 220/4.28, 220/4.33; 297/DIG. 4; 52/66

(56) References Cited

U.S. PATENT DOCUMENTS

| | | | | |
|---|---|---|---|---|
| 3,565,305 | | 2/1971 | Belokin, Jr. . | |
| 3,734,272 | * | 5/1973 | Galen | 206/335 |
| 3,861,092 | * | 1/1975 | Dale et al. | 52/66 |
| 3,945,159 | * | 3/1976 | Girnus, Sr. | 52/66 |
| 4,353,464 | | 10/1982 | Bentler . | |
| 4,378,883 | | 4/1983 | Profeta . | |
| 4,693,289 | * | 9/1987 | Taylor et al. | 206/335 |
| 4,792,039 | * | 12/1988 | Dayton | 206/335 |
| 4,860,935 | | 8/1989 | Paylinsky . | |
| 4,892,190 | | 1/1990 | Delgado . | |
| 4,951,818 | | 8/1990 | Johnson . | |
| 4,991,715 | * | 2/1991 | Williams | 206/335 |
| 5,170,826 | | 12/1992 | Carstensen et al. . | |
| 5,183,180 | | 2/1993 | Hawkins et al. . | |
| 5,199,842 | | 4/1993 | Watt et al. . | |
| 5,207,477 | | 5/1993 | Maxwell . | |
| 5,533,616 | * | 7/1996 | Crowfoot | 206/335 |

FOREIGN PATENT DOCUMENTS 7 3934946 4/1991 (DE) .

* cited by examiner

*Primary Examiner*—Luan K. Bui
(74) *Attorney, Agent, or Firm*—Stroock & Stroock & Lavan LLP

(57) ABSTRACT

An apparatus for storing a wheelchair is provided. The apparatus includes a substantially rigid container dimensioned to receive a wheelchair including a first section and a second section. The first section includes a first end, a first wall extending from the first end, a second wall opposite the first wall, a first side panel extending from the first end positioned between the first and second walls and a second side panel opposite the first side panel. The second section includes a first end, a first wall extending from the first end, a second wall opposite the first wall, a first side panel extending from the first end and positioned between the first and second walls and a second side panel opposite the first side panel. The first section is releasably coupled to the second section to form an interior region for receiving a wheelchair.

14 Claims, 11 Drawing Sheets

WHEELCHAIR CONTAINER

CROSS REFERENCE INFORMATION

This application is a division of U.S. application Ser. No. 08/871,175, filed Jun. 9, 1997, U.S. Pat. No. 6,036,012, which claims priority of Provisional Patent Application No. 60/019,664 filed on Jun. 12, 1996.

BACKGROUND OF THE INVENTION

This invention relates generally to a wheelchair container and more particularly, to a container for a wheelchair that protects it from damage during air travel.

Under the Disability Act, airlines are required to transport wheelchairs free of charge for the general public. In fact, roughly 6.4 million people per year travel with their wheelchairs. As a result, a large and expensive burden is placed on the airline industry. By failing to adequately store a wheelchair in a cargo section of a jet, it is extremely common for the wheelchair to be damaged upon reaching its destination. In fact, the lack of a suitable container forces the airlines to spend at least $1.00 in repairs for every wheelchair carried. As wheelchairs become more expensive (wheelchairs range in price between $600.00 and $20,000.00) and more prevalent, the repair and administrative cost will become a more significant expense of the airlines bottom line However, any container will not solve the above problem. Numerous factors must be taken into account in order to design one suitable for air travel including weight, uniformity, durability, ease to load and cost. In a typical example, a passenger reaches the airport less than one hour before take-off. In that one hour period, the wheelchair must be processed, packaged and loaded onto the plane. The baggage handlers for the airlines neither have the time, nor the training to disassemble the chair, rather they have just enough time to securely load it in the plane. As a result, certain traveling cases in the market place will not meet the demands of the airline industry. For example, a traveling case for a bicycle exists. However, the bicycle needs to be disassembled in order to be securely fastened in the container. That is, the handle bars, at least one wheel and the pedals are all removed. Thereafter, each piece is individually secured and mounted with foam, a process which can take in excess of one hour. Because the process is so labor intensive, the passenger loads and stores the bicycle prior to arrival at the airport. However, in the case of a disabled person, he uses the wheelchair to arrive at the airport. Therefore, he can not load it until he has checked-in.

Accordingly, it is desired to provide a container for a wheelchair that is light weight, durable and easy to load to enable the wheelchair to be shipped without damage.

SUMMARY OF THE INVENTION

Generally speaking, in accordance with the present invention, an apparatus for storing a wheelchair is provided. The apparatus includes a substantially rigid container dimensioned to receive a wheelchair including a first section and a second section. The first section includes at least a first end, a first wall extending from the first end, a second wall opposite the first wall, a first side panel extending from the first end positioned between the first and second walls and a second side panel opposite the first side panel. The second section includes a first end, a first wall extending from the first end, a second wall opposite the first wall, a first side panel extending from the first end and positioned between the first and second walls and a second side panel opposite the first side panel. The first section is releasably coupled to the second section to form an interior region for receiving a wheelchair.

Another apparatus for receiving a wheelchair is provided comprising a substantially rigid container dimensioned to receive a wheelchair including a first section and a second section. The first section includes at least a first end, a first wall extending from the first end, a second wall opposite the first wall, a first side panel extending from the first end and positioned between the first and second walls and a second side panel opposite the first side panel. The second section is substantially flat. The first section is releasably coupled to the second section to form an interior region for receiving a wheelchair.

Accordingly, it is an object of the invention to provide an improved container for securely storing a wheelchair during transportation.

Another object of the invention is to provide a container for a wheelchair that is lightweight, durable and easy to load to enable the wheelchair to be shipped without damage.

Still other objects and advantages of the invention will in part be obvious and in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

In general, there are three distinct types of wheelchairs in the marketplace. All of which have different factors that must be taken into account in designing a proper container for air travel. While reference is being specially made for air travel, these containers may be used at home or for ship, train or truck cargo containers. Each model, that is, a folding wheelchair, a large fixed motorized wheelchair and a motorized scooter, will be described below in greater detail.

Figure 1:
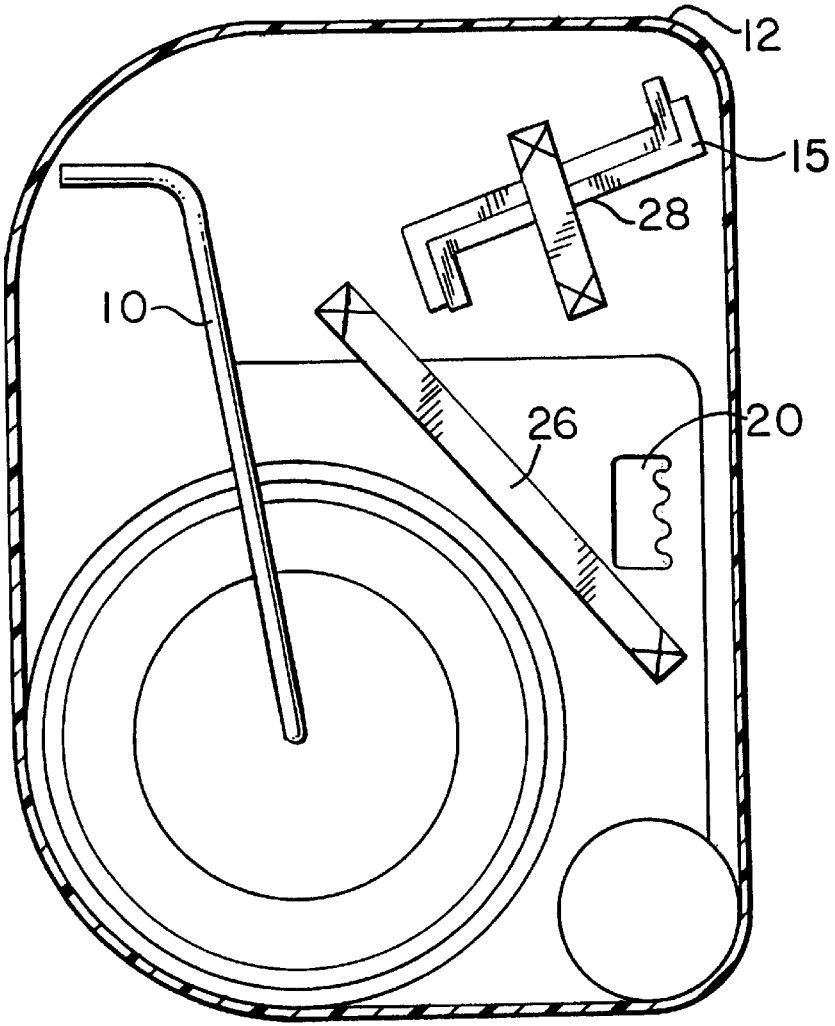
FIG. 1 is a sectional top plan view of a wheelchair in a container in accordance with the invention.
Figure 3:
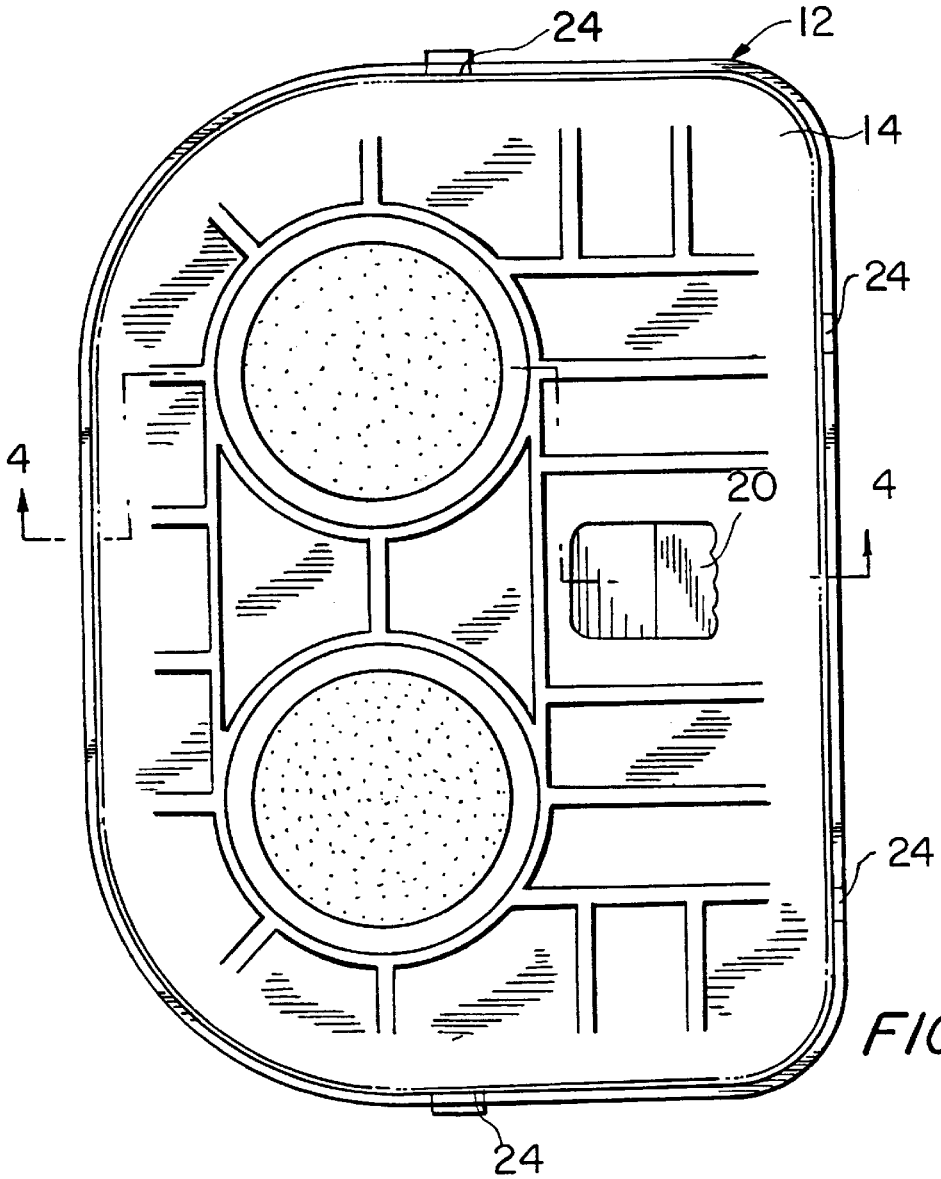
FIG. 3 is a top plan view of the container of FIG. 1.

A folding wheelchair 10 as shown in FIG. 1 weights approximately fifty (50) pounds. For travel, unlike the other two embodiments discussed below, wheelchair 10 may be folded. Referring to FIGS. 1–8, a container 12 for wheelchair 10 is disclosed. Container 12 is dimensioned so that its interior volume is slightly greater than the dimensions of wheelchair 10. In this manner, wheelchair 10 fits within container 12 with minimum movement and at the same time minimizes material cost. In a preferred embodiment, container 12 is approximately 44×33×14 inches and weighs approximately 16 pounds.

Container 12 is typically made of plastic including polyethylene, polypropylene and ABS. It may be molded from using rotational molding, thermoforming or injection molding. The method of manufacturing depends on the cost and rigidity required of the particular design. The outer surface of container 12 is textured. In this manner, its surface is rough so that it does not slip out of the hands of the baggage handlers, while at the same time creates sufficient surface friction with the conveyor belt during loading. This is a critical feature in that large aircraft have steep conveyors for loading baggage. Therefore, in order to enable container 12 to reach the cargo hull, the surface of container 12 must be textured in order to remain on the conveyor.

Figure 8:
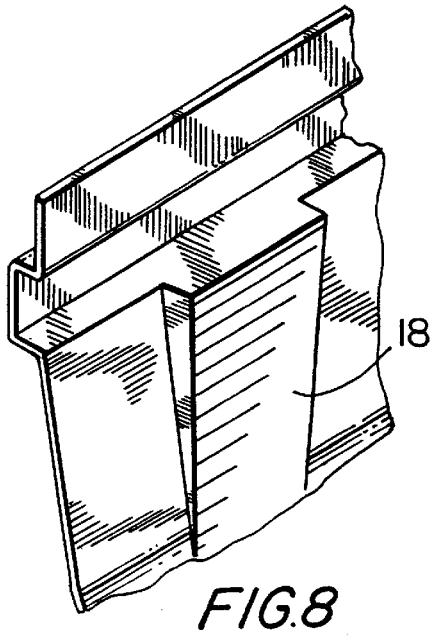
FIG. 8 is a partial enlarged sectional view of a ridge of the container of FIG. 1.

Container 12 is comprised of two halves 14 and 16, which are essentially mirror images of one another. Container 12 is reinforced by ridges 18 as best shown in FIG. 8. Ridges 18 provide additional support for container 12 so that when a plurality of containers 12 are stacked one upon another during shipment, for example, the container can adequately support and handle the weight.

Half 14 is mounted to half 16 of container 12 via a hinge 22. Hinge 22 can be a living hinge or piano hinge. In an alternative embodiment, hinge 22 can be replaced with additional latches 24, described below in greater detail. In this manner, container 12 may be easily stacked along the airport terminal because halves 14 and 16 fit inside one another.

Figure 6:
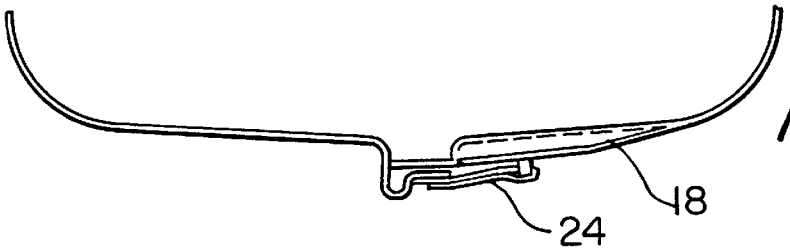
FIG. 6 is an enlarged cross-sectional view taken along line 6—6 of FIG. 5.
Figure 7:
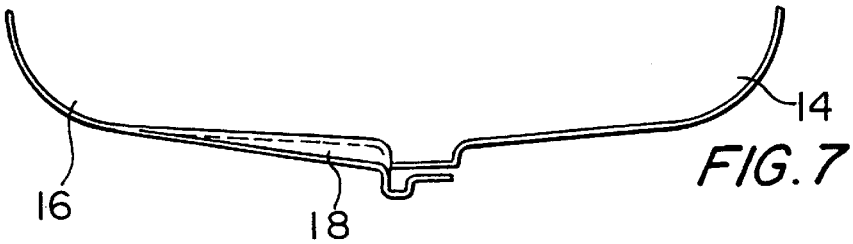
FIG. 7 is an enlarged cross-sectional view taken along line 7—7 of FIG. 5.

Half 14 is fastened to half 16 via latches 24 as best shown in FIG. 6. As shown in FIG. 6, the latch mechanism is a strap of Velcro7 which is fed through a belt hole and then strapped down to the other side of the Velcro7. Alternatively, a rotary action latch, a flexible draw latch or an overcenter latch may be used, as will be described in greater detail below with reference to FIG. 15.

Figure 4:
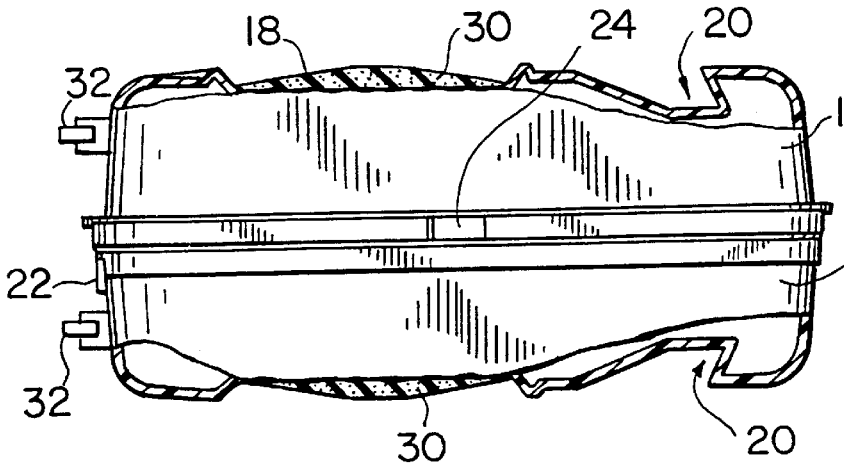
FIG. 4 is a cross-sectional view taken along line 4—4 of FIG. 3.
Figure 5:
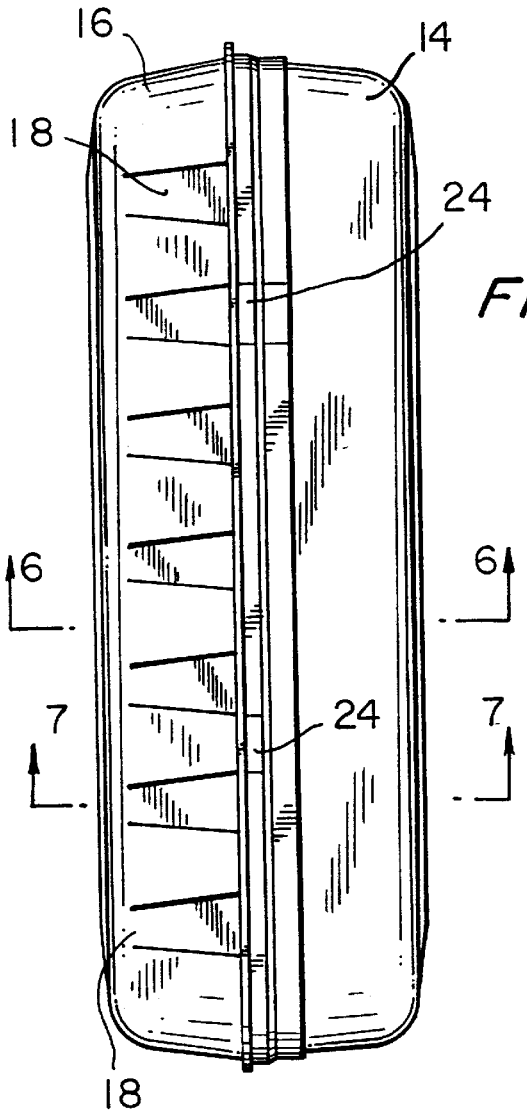
FIG. 5 is a side elevational view of the container of FIG. 1.
Figure 9:
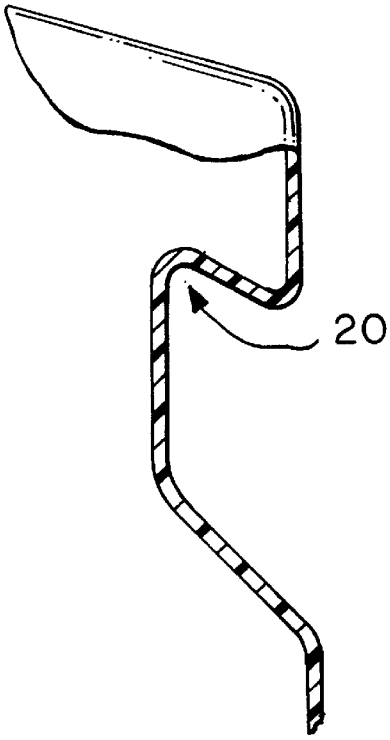
FIG. 9 is an enlarged sectional view of a handle of the container of FIG. 1.
Figure 10:
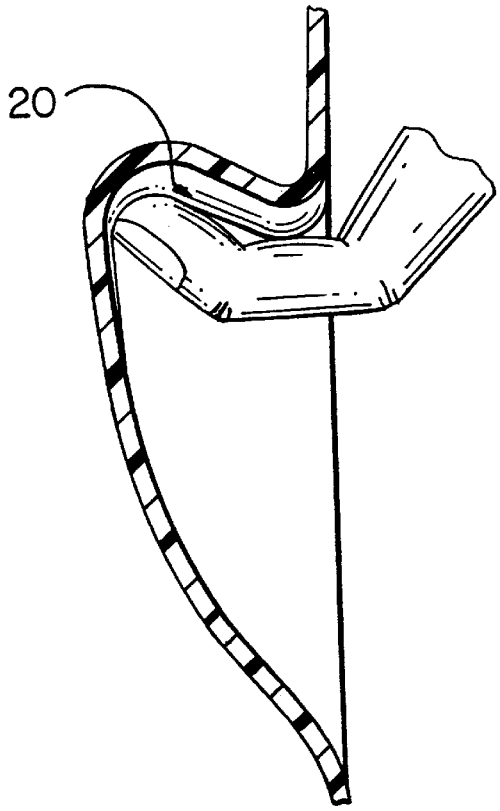
FIG. 10 is an enlarged sectional view of a handle of the container of FIG. 1.
Figure 11:
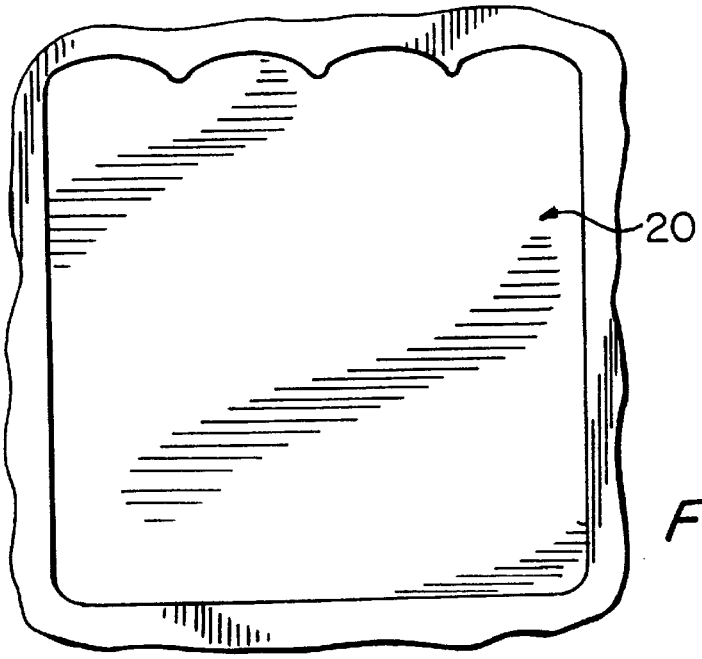
FIG. 11 is a front elevational view of a handle of the container of FIG. 1.

Handles 20 are provided about the exterior surface of container 12 as best shown in FIGS. 9, 10 and 11. Handles 20 form a part of container 12 and are ergonomically designed so as to fit the hand or fingers of the baggage handlers. In this manner, two baggage handlers may walk along each side of container 12 and easily carry it. Alternatively, rollers 32 as shown in FIG. 4 may be used so that container 12 may be rolled.

Figure 2:
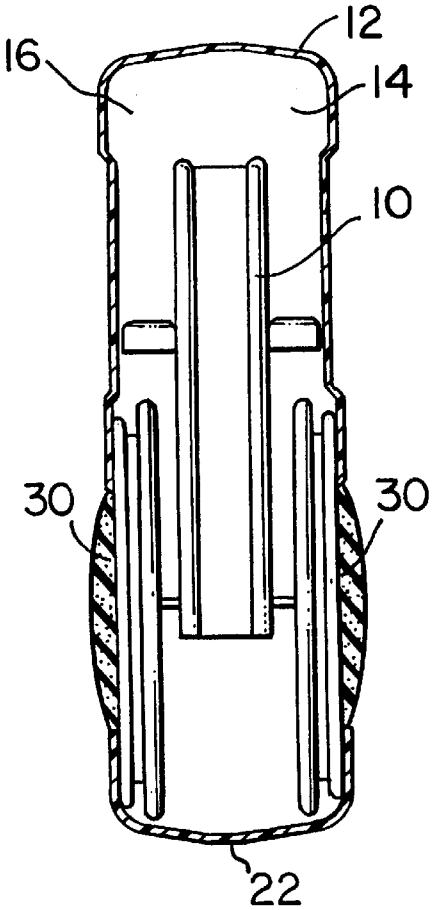
FIG. 2 is a sectional view of a wheelchair in the container of FIG. 1.

To use container 12, wheelchair 10 is delivered to the baggage handlers at the airport. The chair is folded in half to a position as best shown in FIG. 2. The container is opened about hinge 22. Foam 30, as best shown in FIGS. 2 and 4, is positioned on the inner portion of each half 14 and 16. Foot rests 15 are first removed from wheelchair 10. Thereafter, folded wheelchair 10 is placed within container 12 with the large wheels placed upon foam 30. A strap 26 is then mounted up and over the frame to securely fasten wheelchair 10 to half 16 of container 12. In the preferred embodiment, velcro straps are used, however, any type of buckle-strap arrangement, which provides the necessary security may be used. Footrests 15 are then mounted about a strap 28 within container 12. Half 14 is then folded about hinge 22 toward half 16. Thereafter, latches 24 are locked to securely attach half 14 to half 16. In the preferred embodiment, four latches are used, but any number of latches may be used so long as they securely fasten the two halves to one another. Thereafter, a tag is placed on the outer surface of container 12 to appropriately label the container with the destination and passengers name.

Reference is now made to FIGS. 12–15, which describe an embodiment of a container for a large fixed motorized wheelchair 50. Like numbers are used to denote like parts. Wheelchair 50 weighs approximately 250 pounds. Unlike folding wheelchair 10 above, wheelchair 50 cannot be folded for transport.

Wheelchair 50 is mounted in a container 52. In a preferred embodiment, container 52 weighs approximately forty-five (45) pounds and includes bottom dimensions of approximately 49×40×32 inches and top dimensions of 49×40×30 inches. Container 52 includes two portions, a hood 54 and a base 56. The inside volume of container 52 is slightly greater than that of wheelchair 50. Container 52 is constructed by the same method and with the same materials as container 12. Container 52 also includes the same textured surface and parts, including handles 20, latches 24, and ridges 18 as that described above with respect to container 12.

Figure 12:
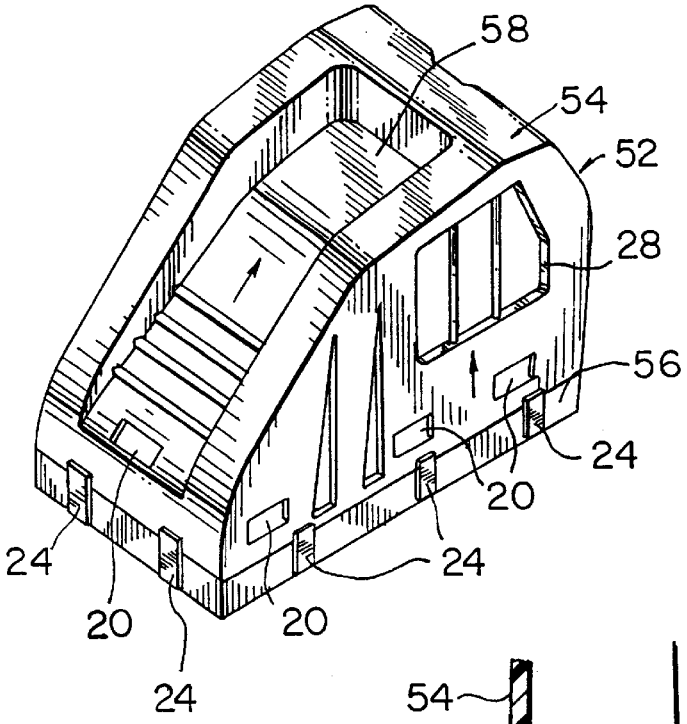
FIG. 12 is a perspective view of a container constructed in accordance with another embodiment of the invention.
Figure 13:
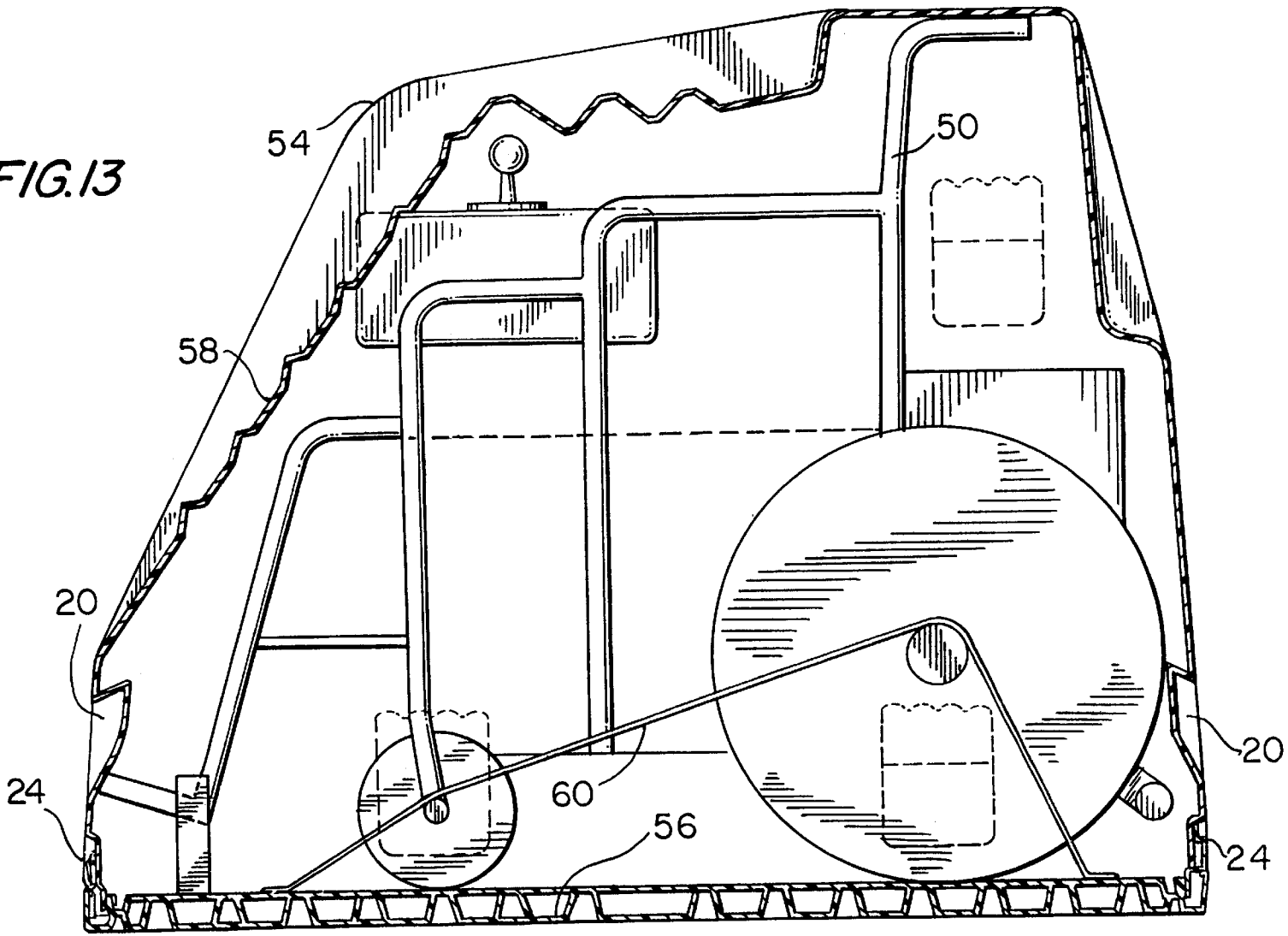
FIG. 13 is a sectional side elevational view of the container of FIG. 12.
Figure 14:
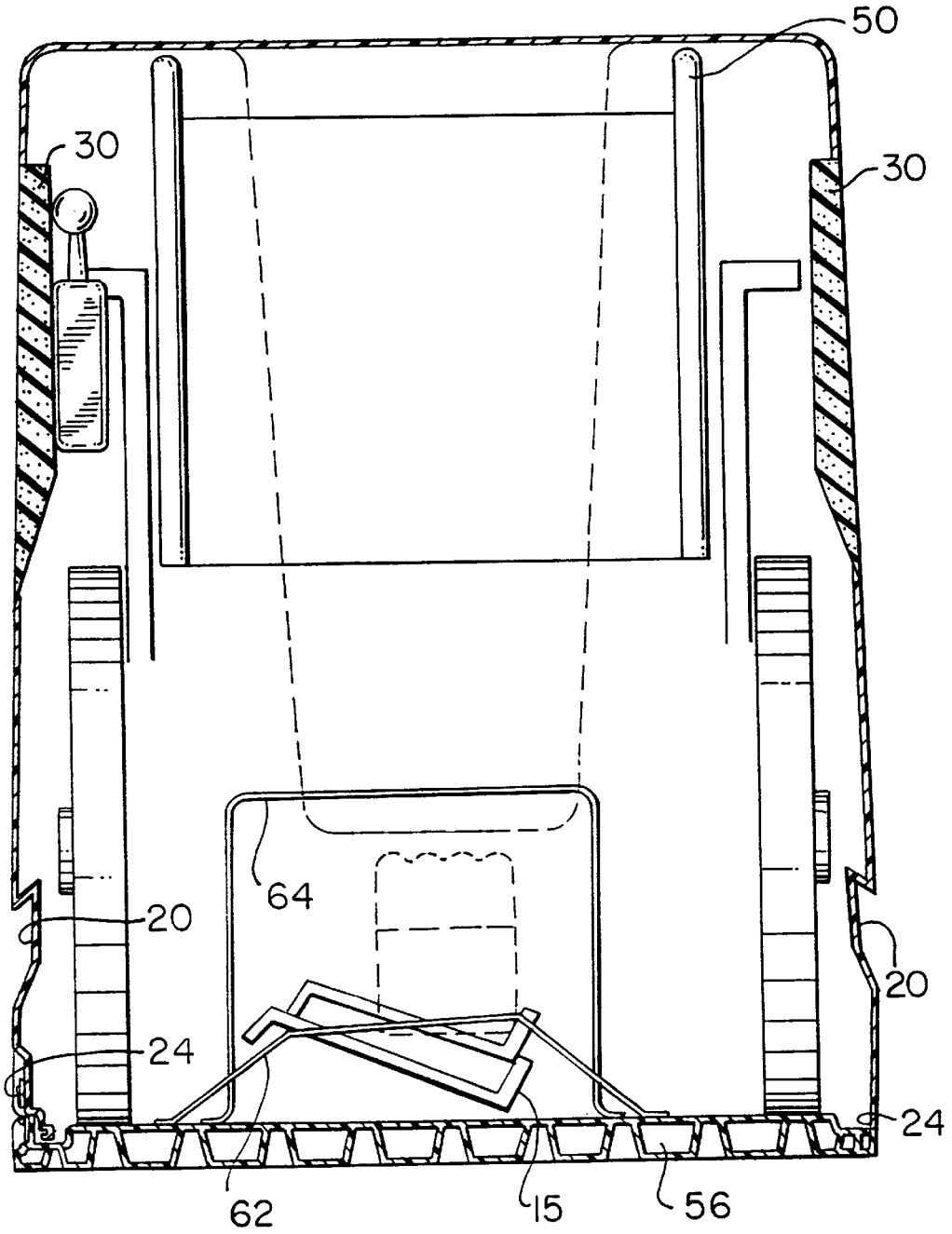
FIG. 14 is a sectional rear elevational view of the container of FIG. 12.
Figure 16:
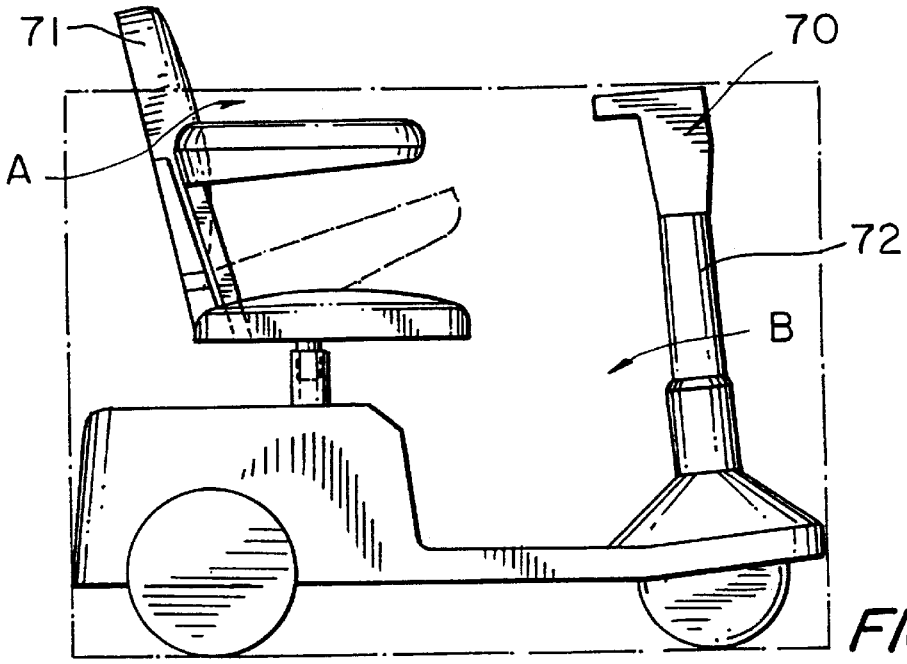
FIG. 16 is a front plan view of a scooter.
Figure 17:
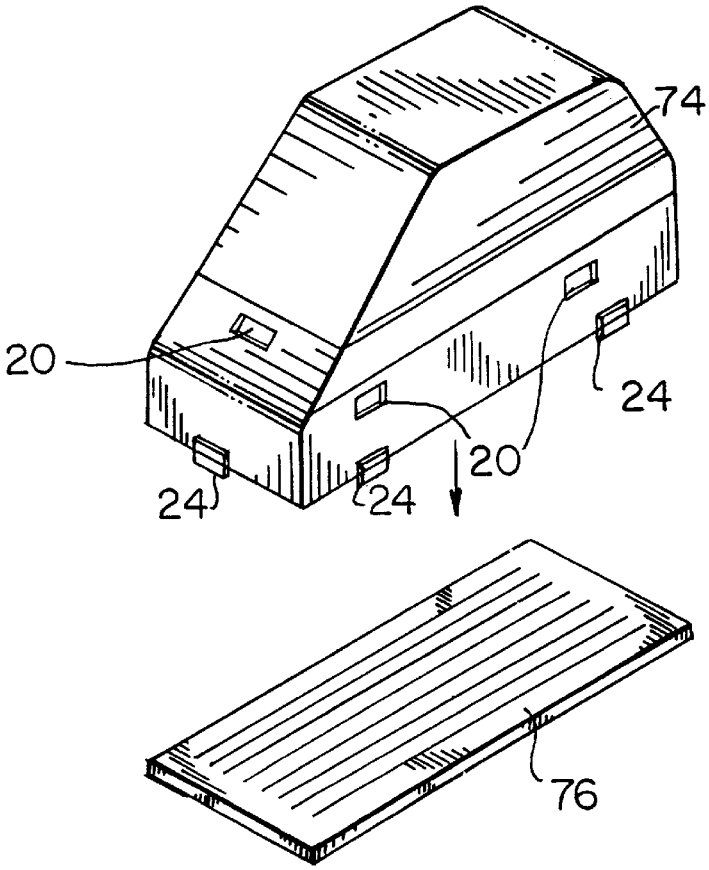
FIG. 17 is an exploded perspective view of a container constructed in accordance with still another embodiment of the invention.
Figure 19:
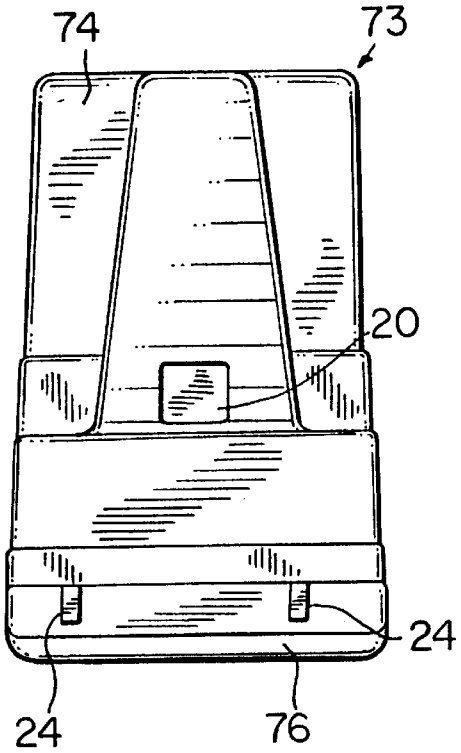
FIG. 19 is a rear elevational view of the container of FIG. 17.

Hood 54 includes an indent region 58 as best shown in FIGS. 12 and 13. Indent 58 reduces the overall amount of material required and forms a tight fit for wheelchair 50 within hood 54. Base 56 is constructed of a rigid honeycomb construction. A honeycomb construction is well known in the art and requires the minimal amount of material, but provides for the rigidity of the part. Foam 30 is placed in various areas about hood 54, and more particularly about the joy stick, microcomputer box and regulator. In particular, foam 30 is required about the sensitive electronic and mechanical components of wheelchair 50, but may be placed anywhere the user feels appropriate.

To use container 52, like the embodiment described above, wheelchair 50 is delivered to the baggage handlers. The battery of wheelchair 50 is disconnected and removed and transported separately due to federal regulation. At the destination, the battery is reinstalled and reconnected to wheelchair 50. Footrests 15 are also removed. Wheelchair 50 is then pushed onto base 56 and strapped down thereon. In particular, a wheel strap 60 as best shown in FIG. 13 is mounted about the axis of the wheels of wheelchair 50. Thereafter, strap 64 may be used to mount wheelchair 50 on base 56. Strap 64 is attached in a direction perpendicular to wheel strap 60. A strap 62 is used to mount footrests 15 to base 56. The number and positioning of straps 60, 62 and 64 are only critical to the extent that it secures wheelchair 50 to base 56. As a result, any number of straps, positioned in any particular position, may be used so long as wheelchair 50 does not rotate or shift during travel.

Figure 15:
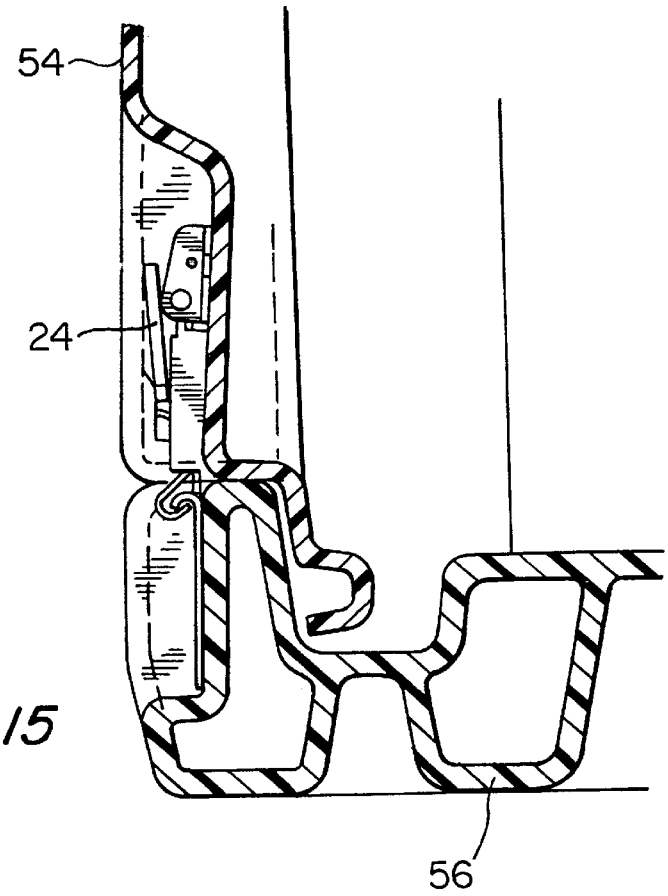
FIG. 15 is a partial enlarged sectional view of the latch mechanism of the container of FIG. 12.

Thereafter, hood 54 is lifted and placed atop wheelchair 50. Hood 54 is then latched to base 56 via latches 24. In the preferred embodiment eight latches are used, two on each end and three on each side but any number of latches may be used so long as hood 54 is securely mounted to base 56. As best shown in FIG. 15, latches 24 are recessed within container 52. In this manner, container 52 does not have any extruding parts to catch on the conveyor belt, clothing or other bags. Based on the fact that latches 24 are flush to container 52, container 52 may be loaded flush against other containers during transport. Therefore, no space is wasted and the container is less likely to move. Once hood 54 is securely latched to base 56, container 52 is laid on its side for loading onto the airplane. If not rolled over, it will not fit in the standard cargo door of a plane from the conveyor belt. Because it is laid on its side, it is extremely important that wheelchair 50 be securely mounted to base 56. Once in the plane, container 52 is rolled back onto base 56 for transport.

Figure 18:
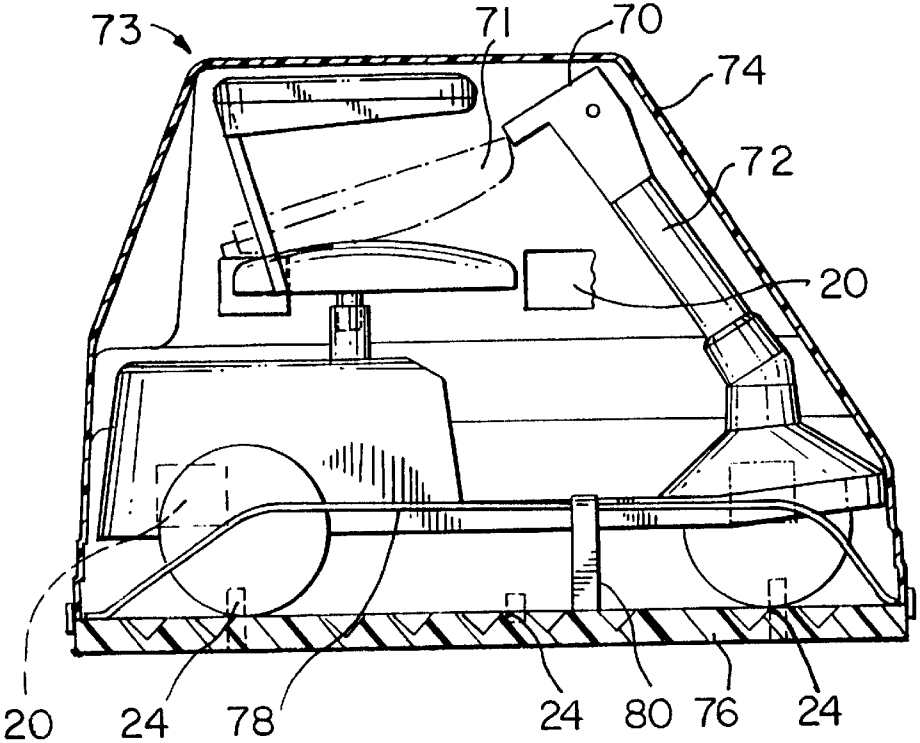
FIG. 18 is a sectional side elevational view of the container of FIG. 17.

Reference is now made to FIGS. 16–19 which describes and discloses a container 73 for a motorized scooter 70. Motorized scooter 70 weights approximately 150 pounds. Like numbers are used to denote like parts in container 73 as discussed above with respect to containers 12 and 52. In a preferred embodiment, container 73 weighs approximately 31 pounds and has the approximate dimensions of 49×35×25 inches. Scooter 70 includes a seat 71 and a steering column 72. Prior to being inserted into container 73, seat 71 is folded in the direction of arrow A to a position as denoted by the double dash lines in FIGS. 16 and 18. At the same time, steering column 72 is moved in the direction of arrow B to a position as shown in FIG. 18. In this manner, the dimensions of scooter 70 have been minimized so as to securely fit within container 73. The interior volume of container 73 is slightly greater than that of scooter 70.

Container 73 includes a hood 74 and a base 76 with ridges 18 positioned thereon to provide further support. The construction and materials of hood 74 and 76 are identical to that described above with respect to containers 12 and 52. Moreover, approximately eight latches 24, three on each side and two on each end are provided to securely attach hood 74 to base 76. Moreover, handles 20 are placed about hood 74 to enable baggage handlers and the like to carry container 73 to the plane. A strap 78 mounted to base 76 is used to securely fasten scooter 70 to base 76. A strap 80 is used to further mount scooter 70 to base 76 and is fitted in a direction essentially perpendicular to strap 78.

Figure 20:
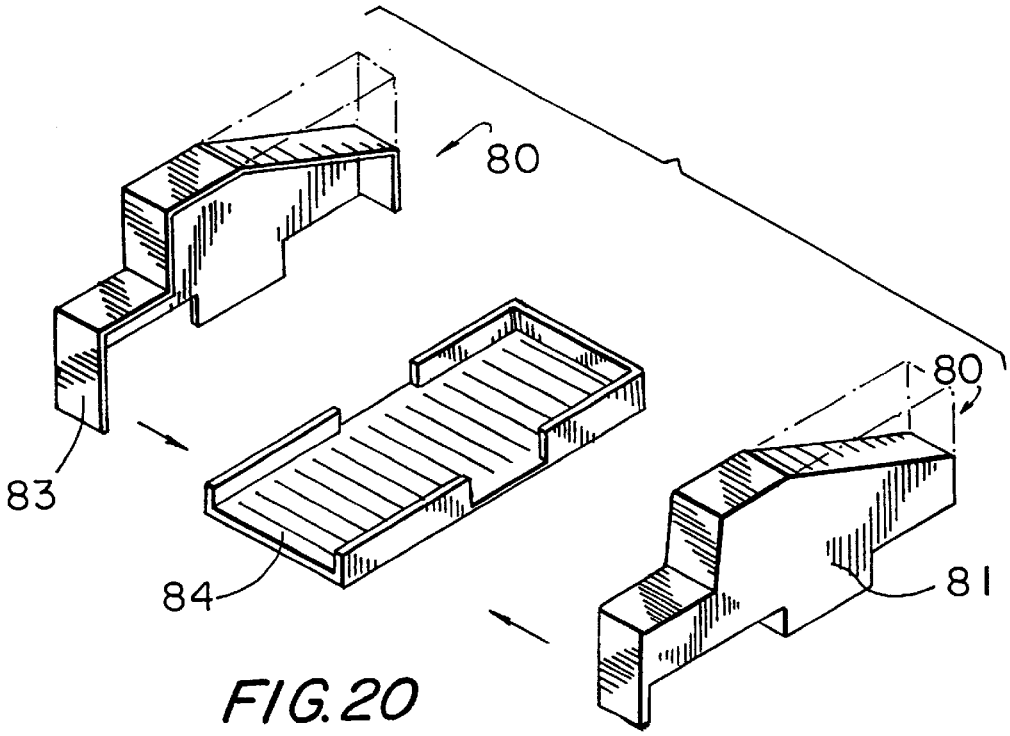
FIG. 20 is an exploded perspective view of a container constructed in accordance with yet another embodiment of the invention.

In an alternative embodiment, container 52 or 73 could be constructed in the form as shown in FIG. 20. In FIG. 20, a hood 80 is formed with a first half 81 and a second half 83. As shown with dashed lines, hood 80 can be formed in any shape. That is, it may be configured for a scooter 70 or alternatively for a wheelchair 50. In this embodiment, handles, latches, ridges and materials are the same as those described above with respect to the other embodiments. To use the embodiment of FIG. 20, a wheelchair is rolled onto base 84. Thereafter, a half 81 and a half 83 are moved towards base 84 and are fastened to one another by any type of latch disclosed herein. Thereafter, base 84 is securely fastened to halves 83 and 84 to protect a wheelchair during transport.

Figure 21:
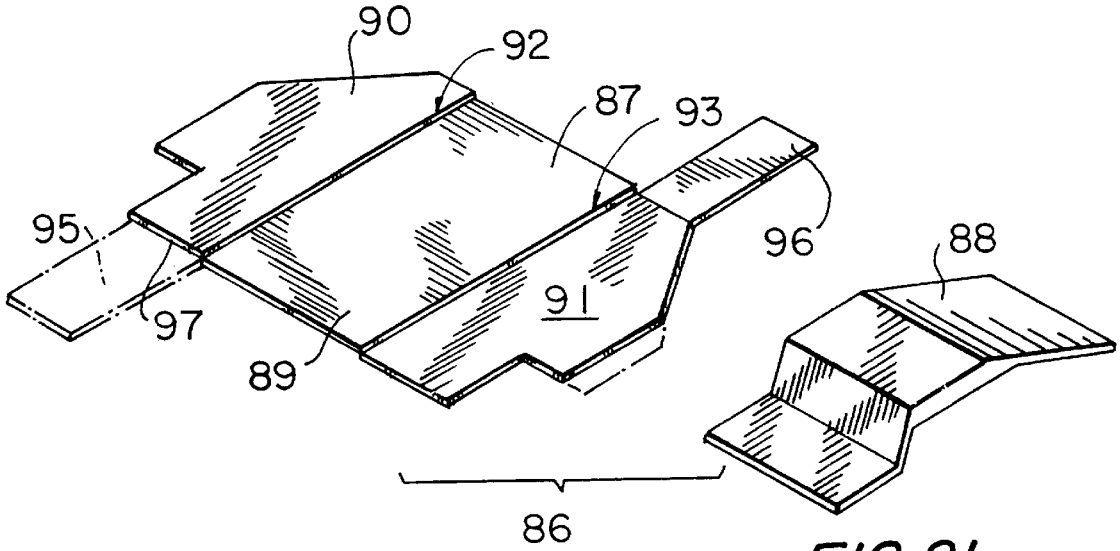
FIG. 21 is an exploded perspective view of yet still another embodiment of a container constructed in accordance with the invention.
Figure 22:
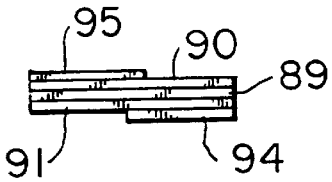
FIG. 22 is a front plan view of the base of the container of FIG. 21 in the storage position.

Reference is now made to FIGS. 21 and 22 which describe a further embodiment of the invention. In this embodiment, a container 86 constructed of the same materials and including the same parts as described above with respect to the other embodiments includes a base 87 and a hood 88. In this embodiment, a wheelchair is rolled onto a platform 89 of base 87. Thereafter, side walls 90 and 91 are folded upwards about a hinges 92 and 93, respectively, while end walls 94 and 95 are folded about hinges 96 and 97, respectively, to form the base and side walls of container 86. Thereafter, hood 88 is placed upon base 87. The various walls are latched to one another and thereafter, hood 88 is mounted to side walls and end walls 90, 91, 94 and 95. When not in use, base and side walls 87 may be folded to a position as best shown in FIG. 22 for storage. In this embodiment, the end walls and side walls may take on any shapes so long as it fits a wheelchair snugly within. Similar to the above embodiments, straps, latches and handles are placed in the various positions so as to securely fasten a wheelchair upon platform 89 during transport.

Figure 23:
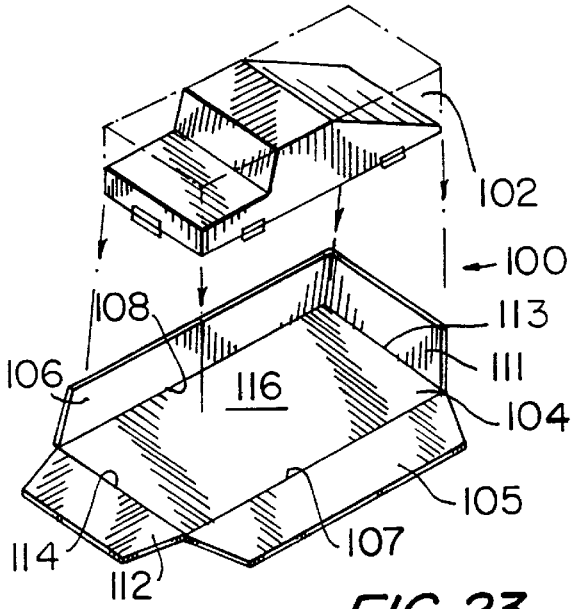
FIG. 23 is an exploded perspective view of a container in accordance with another embodiment of the invention.
Figure 24:
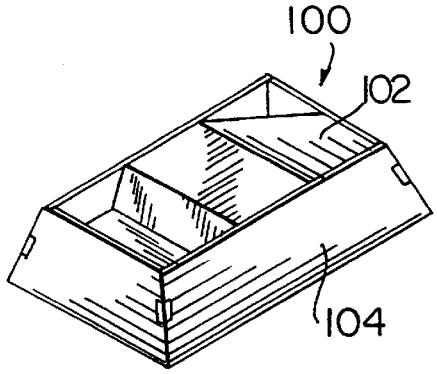
FIG. 24 is a perspective view of the base and hood of the container of FIG. 23 in a storage position.

Reference is now made to FIGS. 23 and 24 which describe a further alternative embodiment of the invention. In this embodiment, container 100 includes a hood 102 and a base 104. Base 104 includes a platform 110. Base 104 also includes side walls 105 and 106 mounted about hinges 107 and 108, respectively. End walls 111 and 112 are further provided on base 104 and are mounted about hinges 113 and 114, respectively. Thereafter, side walls 105 and 106 are latched to end walls 111 and 112 in the same manner described above. Thereafter, hood 102 is connected to side walls 105, 106 and end walls 111 and 112 and is securely fastened thereon to store a wheelchair. When not in use, the side walls and end walls are placed in an upright position and the hood is placed therein for storage as best shown in FIG. 24. In this embodiment, the methods of attachment and storage as well as the materials used to manufacture the parts are the same as described above with respect to containers 12, 52 and 73.

Figure 25:
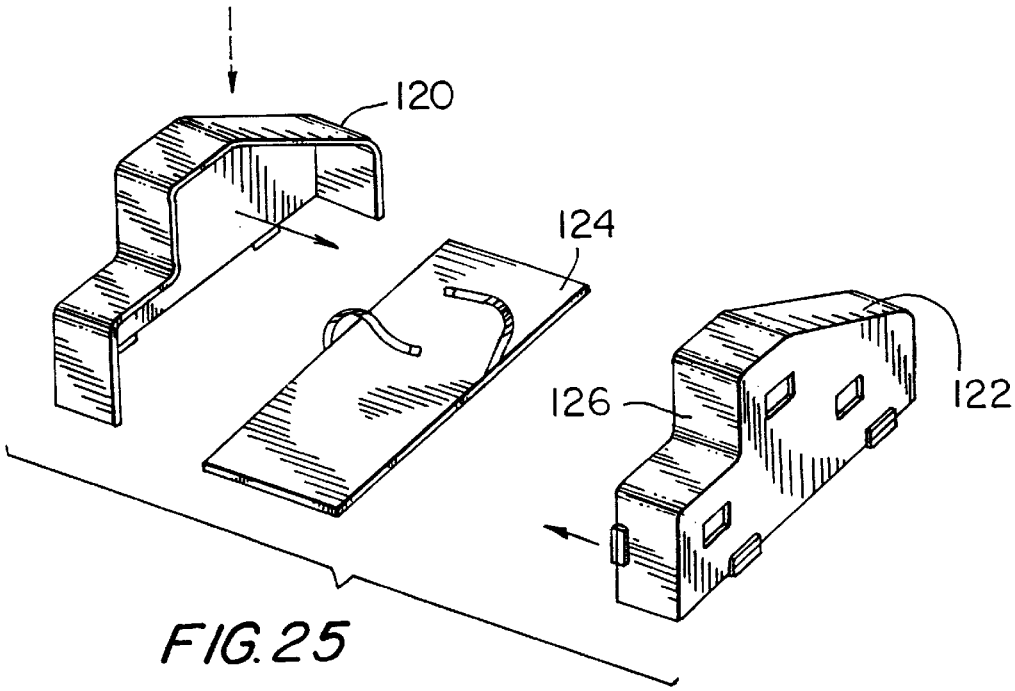
FIG. 25 is an exploded perspective view of a container in accordance with still another embodiment of the invention.

Reference is now made to FIG. 25 which describes still another embodiment of the invention. In this embodiment hood sections 120 and 122, which are mirror images of one another, form a hood to be attached to a base 124. In this embodiment, a wheelchair is rolled onto base 124 and is connected with a single strap 126. Thereafter, hood sections 120 and 122 are securely coupled to base 124 and to one another in the manner described above with respect to containers 12, 52 and 73. Similar to the above embodiments, these component parts are made of the same material and used essentially the same parts for handles, latches and the like.

It will thus be seen that the objects set forth above, among those made apparent from the preceding description, are efficiently attained and, since certain changes may be made in the above constructions without departing from the spirit and scope of the invention, it is intended that all mater contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A container system for storing and transporting a motorized wheelchair, comprising:

a motorized wheelchair having a motor, a seat, a back rest and two arm rests;

a base of sufficient rigidity to support a wheelchair weighing at least 250 pounds and substantially maintain its shape, the base having a top surface and a perimeter edge, and a front wall, a rear wall and two side walls depending downwards from the perimeter edge of the top surface, with the wheelchair fastened to the top surface;

a hood dimensioned to fit over the wheelchair and onto the base, the hood having an outer surface defining an exterior and an inner surface defining an interior, and having a lower perimeter edge engaging the base;

the interior of the top being dimensioned to receive the motorized wheelchair and having an inwardly projecting surface to extend into the space bounded by at least two of the arm rests, the back rest and the seat, to limit movement of the wheel chair with respect to the hood and the base;

the outer surface of the hood having an asymmetrical appearance to define a front and a back thereof, and handgrips at the sides thereof.

2. The container of claim 1, wherein the perimeter edge of the base and the lower perimeter edge of the hood engage with a tongue in groove fit.

3. The container of claim 2, wherein the top surface of the base includes a downwardly extending groove around the perimeter edge thereof for receiving the lower perimeter edge of the hood.

4. The container of claim 1, wherein the hood and base include latches for securing the hood to the base, the latches including one portion on the hood and another portion on the base and one of the portions include a hook-like structure which engages a ridge structure on the other portion.

5. The container of claim 4, wherein the latches are of a type to draw the hood and base more tightly together and substantially prevent vertical separation when closed, but which are not bounded against side-to-side relative movement before they are closed.

6. The container of claim 5, where there are latches on the front, rear and both sides of the container.

7. The container of claim 4, wherein the latches are recessed into the sides of the container.

8. The container of claim 1, wherein the base has a top surface and a bottom surface and a honeycomb structure between the top and bottom surfaces.

9. The container of claim 1, wherein the hood includes an indent in the front thereof to provide the inwardly projecting interior surface.

10. The container of claim 1, wherein at least three straps are joined to the base for securing the wheelchair thereto.

11. The container of claim 1, wherein the configuration of the hood and strap arrangement and construction is such that the wheelchair is secured to the base securely enough to remain attached to the base after the container is tipped from an upright position onto its side and will return to substantially its original position after the container is tipped back to the upright position.

12. The container of claim 11 wherein the hood is made to be sufficiently rigid to maintain its shape after the container with wheelchair therein is laid on its side with the side of the hood resting on the floor.

13. The container of claim 1, wherein the hood is stiffened by a plurality of ridges formed integrally therein.

14. The container of claim 6, wherein the latches are asymmetrically arranged on the sides, to prevent latching if the hood is put onto the base backwards.

* * * * *